US006553580B1

(12) United States Patent
Henson

(10) Patent No.: US 6,553,580 B1
(45) Date of Patent: Apr. 29, 2003

(54) METHOD OF PROTECTING A HELMET SHELL AND INTERRUPTING AIRFLOW AROUND THE SHELL WITH A REMOVABLE STRIP

(76) Inventor: Dale L. Henson, 2123 Bering Dr., Ste. D, San Jose, CA (US) 95131

( * ) Notice: Subject to any disclaimer, the term of this patent is extended or adjusted under 35 U.S.C. 154(b) by 0 days.

(21) Appl. No.: 09/887,696

(22) Filed: Jan. 16, 2002

Related U.S. Application Data

(63) Continuation of application No. 09/044,685, filed on Mar. 18, 1998, now abandoned.

(51) Int. Cl.[7] ..... A42B 1/06
(52) U.S. Cl. ..... 2/410; 2/422; 2/425
(58) Field of Search ..... 2/410, 411, 422, 2/424, 425

(56) References Cited

U.S. PATENT DOCUMENTS 5,097,538 A * 3/1992 Feuling ..... 2/410
5,575,018 A * 11/1996 Rothrock ..... 2/424
5,732,414 A * 3/1998 Monica ..... 2/425

FOREIGN PATENT DOCUMENTS

| | | | | |
|---|---|---|---|---|
| DE | 3305735 A | * | 8/1984 | ..... A42B/3/02 |
| DE | 3444404 A1 | * | 6/1986 | |
| DE | 253759 A1 | * | 2/1988 | |
| EP | 131929 A2 | * | 1/1985 | ..... A42B/3/00 |
| FR | 2645719 A | * | 10/1990 | ..... A42B/3/04 |
| JP | 63-24083 B2 | * | 5/1988 | |

* cited by examiner

*Primary Examiner*—Rodney M. Lindsey
(74) *Attorney, Agent, or Firm*—The Kline Law Firm

(57) ABSTRACT

A method of protecting a helmet shell and interrupting airflow around a helmet utilizing an air flow interrupter and helmet shell protector strip. The strip is constructed so that it can be applied to a helmet after manufacture of the helmet shell itself. The strip includes an attachment mechanism which is generally an adhesive backing. This allows the strip to be easily removably affixed to the helmet surface. The attachment mechanism must have sufficient strength so that the strip does not separate from the helmet surface during normal use.

4 Claims, 3 Drawing Sheets

METHOD OF PROTECTING A HELMET SHELL AND INTERRUPTING AIRFLOW AROUND THE SHELL WITH A REMOVABLE STRIP

This application is a continuation of Applicant's U.S. application, Ser. No. 09/044,685, filed Mar. 18, 1998 now abandoned.

FIELD OF THE INVENTION

The present invention relates generally to safety equipment, and more particularly is a method of protecting a helmet shell and interrupting airflow around the helmet that utilizes an airflow interrupter strip that is attached to a helmet of a user.

BACKGROUND OF THE INVENTION

In motor cycling, as well as in any type of freeway speed (above 50 mph) activity in which the participants wear helmets, one of the problems the riders face is the buffeting and suction lift caused by laminar air flow around the helmet.

As illustrated in FIGS. 1 and 2, air flow around a smooth helmet is laminar. At freeway speeds, this creates a low pressure area at the sides and rear of the helmet, leading to a suction force. The suction forces on the sides of the helmet tend to buffet the rider's head back and forth. This has a strong detrimental effect on the rider's balance, comfort, and vision. The suction forces at the rear of the helmet create a lifting effect that tends to raise the rear of the helmet, thereby driving the front of the helmet over the user's eyes. This also has a direct detrimental effect on the rider's vision, which is clearly very undesirable when moving at freeway speeds. The lifting effect's driving the helmet forward also tends to uncomfortably tighten the chin strap of the helmet.

Many devices in the prior art are directed to controlling air flow in the interior of a helmet to cool the user's head while he wears the helmet. Examples of this type of device are the "Bicyclists Helmet with Air Flow and Perspiration Control" by Sundahl et al., U.S. Pat. No. 4,434,514, issued Mar. 6, 1984; and the "Helmet" by Kamiya et al., U.S. Pat. No. 4,519,099, issued May 28, 1985. Both these devices use a plurality of vents to direct the air flow within the helmet.

At least one prior art device has recognized and addressed the buffeting problem in a light helmet used at high speed. The "Aerodynamic Bicycle Helmet" by Rotzin, U.S. Pat. No. 5,023,958, shows a soft shell helmet that utilizes several ridges across an upper front portion of the helmet to disrupt the air flow around the helmet. The device is directed to foam-only helmets (col. 1, lines 55–56). The fact that the helmets are constructed solely from foam allows the manufacturers to easily include the ridges in the outer surface.

However, due to the restrictions of manufacturing processes as well as for aesthetic considerations, most if not all hard shell helmets currently manufactured have a smooth outer surface. The smooth outer surface provides for a laminar local air flow. Furthermore, there is no teaching in the prior art that would provide a device that would allow the user to adjust the air flow interruption to his personal taste or depending on the immediate circumstances. Further, there is no method taught in the prior art to provide a removable air flow interrupter.

Moreover, many helmets are painted and/or decorated quite elaborately to the user's tastes. The appearance of the helmet is subject to damage if the helmet is accidentally dropped or if it were to fall off the handlebars for instance. There is currently no effective means available to protect the helmet shell from this type of low-force impact damage.

Accordingly, it is an object of the present invention to provide a device to modify air flow around the back and sides of a helmet.

It is another object of the present invention to provide a means of low-force impact protection for the helmet itself.

It is a further object of the present invention to provide a means for the user to adjust the position of the air flow interrupters as desired.

It is a still further object of the present invention to provide a means of changing the appearance of the user's helmet if he so desires.

SUMMARY OF THE INVENTION

The present invention is a method of protecting a helmet shell and interrupting airflow around a helmet utilizing a removable flow interrupter strip. The strip is constructed so that it can be applied to a helmet after manufacture of the helmet shell and assembly of the helmet itself. In the preferred embodiment, the strip comprises a main body that has a height of approximately one-quarter inch. The length of the strip is approximately eight to fourteen inches. The width of the preferred embodiment is approximately one-half inch. The exact dimensions of the strip are generally not crucial to the purpose of the invention. The only critical dimension is the height of the strip. When the strip is applied to the surface of a helmet, the height of the strip must be sufficient to interrupt air flow and to protect the helmet finish.

The strip includes attachment means comprising generally an adhesive backing so that the strip may be easily removably affixed to the helmet surface. The attachment means must have sufficient strength so that the strip does not separate from the helmet surface during normal use.

In addition to defining air flow around the helmet, the strip provides protection from damage from low-force impacts. Examples of these types of impacts are those that occur if a helmet falls from handlebars or if the helmet is dropped. The strip is not intended to provide increased protection for the user of the helmet, but the strip does provide protection for the appearance of the helmet.

An advantage of the present invention is that the air flow interrupter strip may be applied to the helmet following manufacture of the helmet.

Another advantage of the present invention is that the strip can be removed and replaced by a user.

A still further advantage of the present invention is that the strip is easily and inexpensively manufactured.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
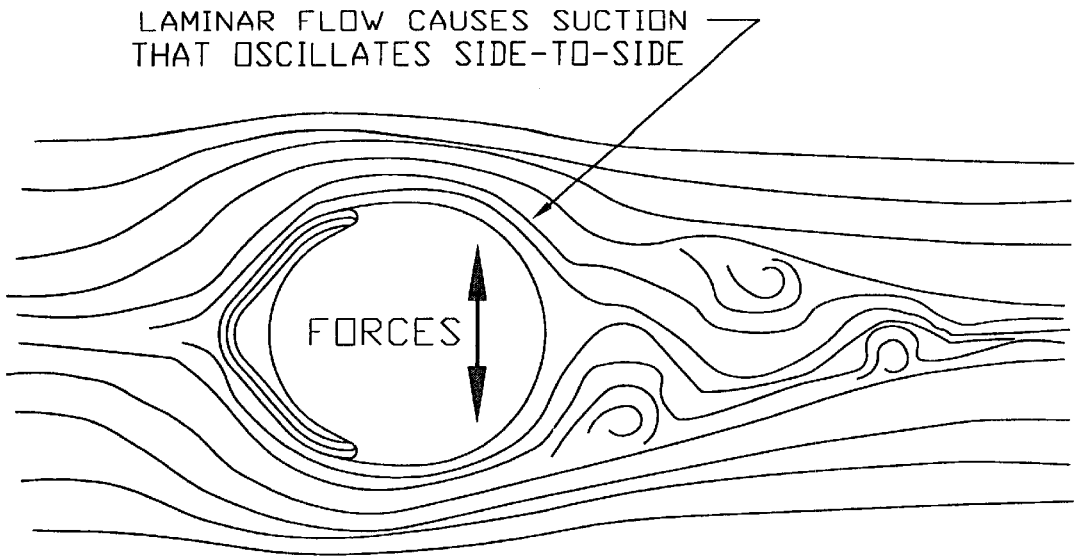
FIG. 1 is a top view of the air pressure forces acting on a smooth hard shell helmet moving at freeway speed without an air flow interrupter strip.
Figure 2:
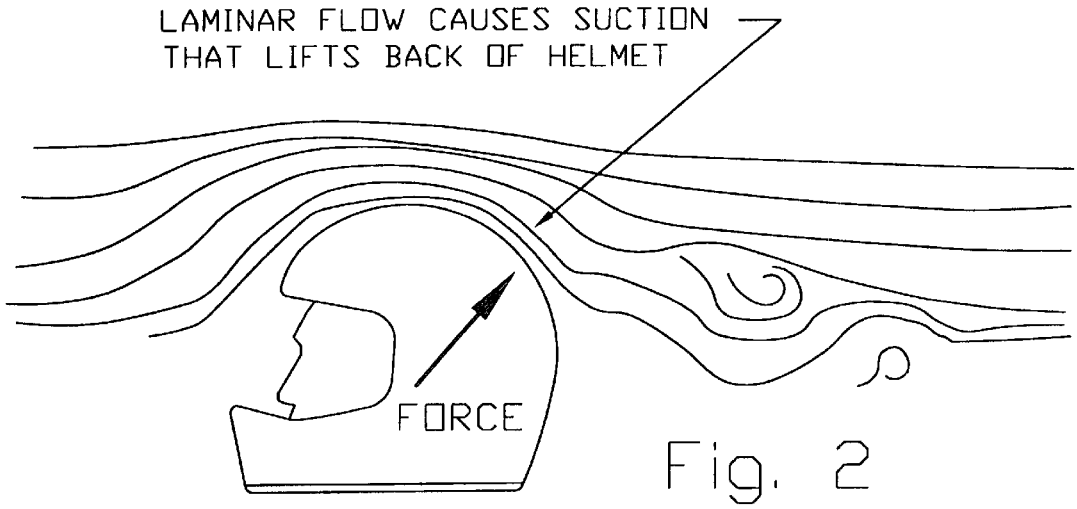
FIG. 2 is a side view of the air pressure forces acting on a smooth hard shell helmet moving at freeway speed without an air flow interrupter strip.
Figure 3:
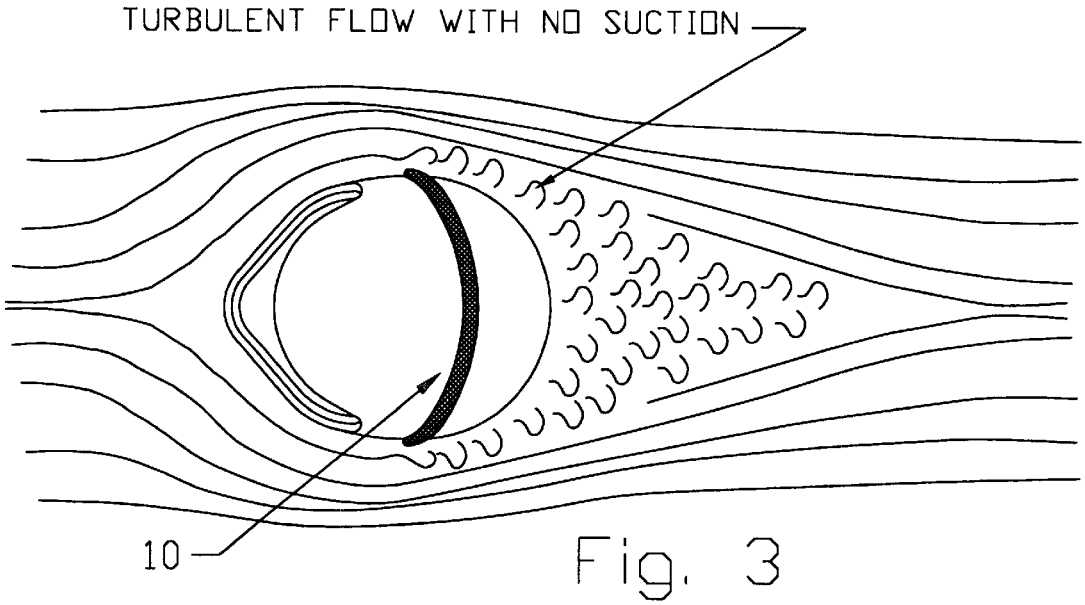
FIG. 3 is a top view of the air pressure forces acting on a smooth hard shell helmet moving at freeway speed with the air flow interrupter strip of the present invention.
Figure 4:
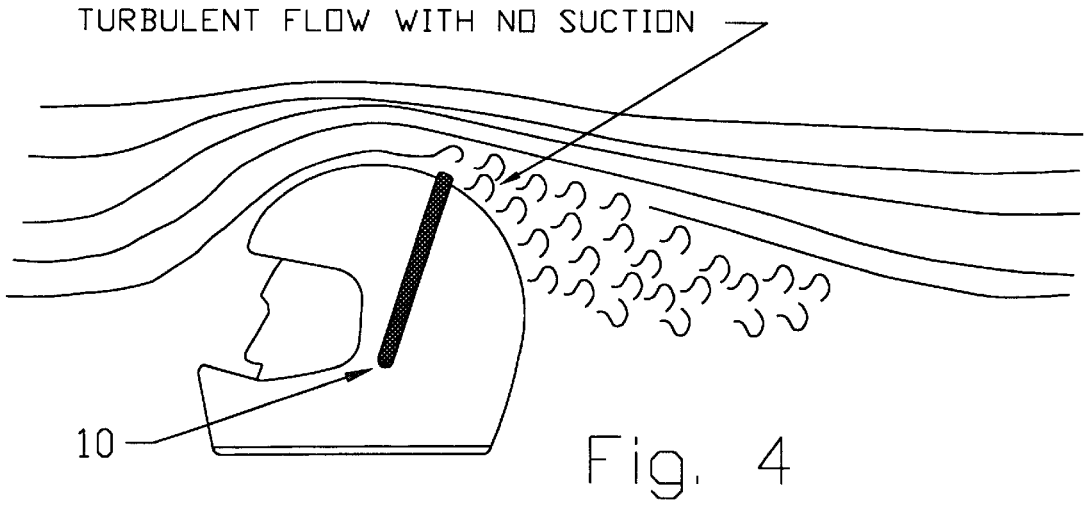
FIG. 4 is a side view of the air pressure forces acting on a smooth hard shell helmet moving at freeway speed with the air flow interrupter strip of the present invention.
Figure 5:
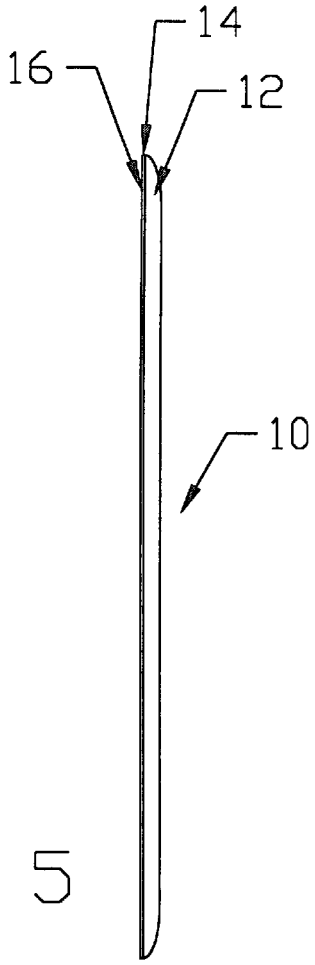
FIG. 5 is a side view of the air flow interrupter strip of the present invention.
Figure 6:
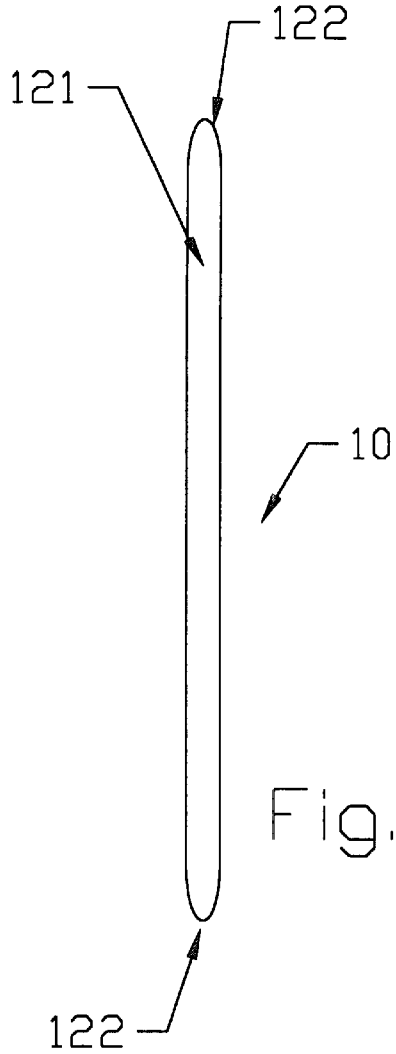
FIG. 6 is a top view of the air flow interrupter strip
Figure 7:
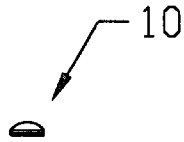
FIG. 7 is an end view of the strip.

The present invention is a method of protecting a helmet shell and interrupting airflow around the helmet. The method utilizes an air flow interrupter strip 10. The strip 10 is constructed so that it can be applied to a helmet after manufacture of the helmet shell and assembly of the helmet itself.

In the preferred embodiment, the strip 10 comprises a main body 12 that has a thickness of from 0.15 inch to 0.45 inch. The strip will generally be approximately one-quarter inch thick. The length of the main body 12 of the strip 10 is approximately eight to fourteen inches. The width of the main body 12 in the preferred embodiment is approximately one-half inch. The exact dimensions of the strip 10 are generally not crucial to the purpose of the invention. The only critical dimension is the height of the strip 10. The height must be sufficient to interrupt air flow and to protect the helmet finish when the strip 10 is applied to the surface of a helmet.

The main body 12 may be formed from nearly any deformable material. In the preferred embodiment, the main body 12 is formed from a flexible plastic. It is envisioned that the main body 12 will generally be formed from ABS or urethane. An upper surface 121 of the main body is textured for efficient air flow interruption and for aesthetic appeal.

The main body 12 is an elongated strip. The ends 122 of the main body 12 are rounded. This removes any fraying that may occur in cutting the strip, and gives the strip a "clean" appearance.

The strip 10 includes attachment means 14. The attachment means 14 will most often in the preferred embodiment comprise generally an adhesive material affixed to an underside of the main body 12. By utilizing an adhesive layer as the attachment means 14, the present invention ensures that the strip 10 can be easily affixed to a helmet shell. The adhesive must have sufficient strength so that the strip 10 does not separate from the helmet surface during use. The use of an adhesive layer as the attachment means 14 further allows the user to remove and replace the strip 10 as desired.

A protective sheet 16 is applied to the adhesive layer 14. The protective sheet 16 is simply non-stick paper that prevents the adhesive layer 14 from adhering to packaging or other objects apart from the helmet.

A user utilizes the strip 10 by simply removing the protective sheet 16 from the adhesive layer 14. The user then applies the strip to the helmet in the desired position. If the helmet is dropped or the strip 10 is otherwise damaged, the user can simply peel off the damaged strip and apply a new one.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A method of protecting a helmet shell and interrupting airflow around a helmet comprising the following steps:

a) forming a strip with an elongated main body, said strip being formed from a flexible material and being of sufficient thickness so as to disrupt laminar air flow when attached to an outer surface of said helmet shell, b) providing an attachment means on said strip, and c) removably attaching said strip to said helmet shell with said attachment means at a location chosen by a user, said location varying according to conditions of a specific application; such that said strip ensures that air flow around said helmet is non-laminar, and said strip further provides shock absorption means to protect said helmet shell.

2. The method of protecting a helmet shell and interrupting airflow around said helmet as defined in claim 1 wherein:

said attachment means is formed by placing a layer of adhesive material on said strip.

3. The method of protecting a helmet shell and interrupting airflow around said helmet as defined in claim 1 wherein:

said main body of said strip is formed with a thickness of from 0.15 in. to 0.45 in.

4. The method of protecting a helmet shell and interrupting airflow around said helmet as defined in claim 1 wherein:

an upper surface of said main body of said strip is formed with a textured surface so as to ensure disruption of air flow around said helmet.

* * * * *